US005576501A

United States Patent [19]

Huang

[11] Patent Number: 5,576,501

[45] Date of Patent: Nov. 19, 1996

[54] TORQUE-CONTROLLING RATCHET CONNECTOR STRUCTURE

[76] Inventor: Chin-Tan Huang, No. 39, Lane 240, Li-Jen Road, Ta-Li City, Taichung Hsien, Taiwan

[21] Appl. No.: 586,933

[22] Filed: Jan. 3, 1996

[51] Int. Cl.[6] ..... B25B 23/00

[52] U.S. Cl. ..... 73/862.23; 81/473

[58] Field of Search ..... 81/473, 475, 477; 73/862.23, 862.22, 862.21

[56] References Cited

U.S. PATENT DOCUMENTS

| | | | |
|---|---|---|---|
| 4,653,359 | 3/1987 | Liao | 81/475 |
| 5,025,903 | 6/1991 | Elligson | 81/475 |
| 5,063,797 | 11/1991 | Huang | 81/63.2 |
| 5,142,953 | 9/1992 | Lin | 81/63.2 |
| 5,239,875 | 8/1993 | Stasiek et al. | 73/862.23 |

*Primary Examiner*—Richard Chilcot
*Assistant Examiner*—Ronald Biegel
*Attorney, Agent, or Firm*—Morton J. Rosenberg; David I. Klein

[57] ABSTRACT

A torque-controlling ratchet connector structure including a main body, a torque mechanism exerting a torque onto a screwdriver bit for rotating the same, a pressure adjustment mechanism for adjusting the torque, a first and a second ratchet wheels selectively clockwise or counterclockwise rotatable and a connector adapted to connect with various screwdriver bits. The torque mechanism includes a toothed disk rotatable along with the main body. By means of the pressing of a pressing plate and a spring of the pressure adjustment mechanism, the first and second ratchet wheels and a washer are forced, making steel balls exert pressure onto the toothed disk so as to rotarily drive a rotary shaft fitted in the hexagonal holes of the ratchet wheels and the washer. The rotary shaft in turn rotates the connector to drive the screwdriver bit.

5 Claims, 6 Drawing Sheets

TORQUE-CONTROLLING RATCHET CONNECTOR STRUCTURE

BACKGROUND OF THE INVENTION

The present invention relates to a torque-controlling ratchet connector structure.

Please refer to FIGS. 1 and 2. A conventional ratchet screwdriver includes a handle 1 and a ratchet mechanism 2 consisting of a sleeve seat 21, a sleeve 22, two detents 23, a controller 24 for controlling the rotational direction, a check plate 25 and a collar 26. The sleeve 22 has a first end formed with a socket 222 for connecting with a screwdriver bit and a second end disposed with a ratchet wheel 221. Each detent 23 has a projection 231 and a stopper section 232. The projection 231 serves to insert into the tooth space of the ratchet wheel 221 for one-way driving the screwdriver bit to rotate. By means of pushing the controller 24, the screwdriver bit can be reversely rotated.

The above ratchet wheel 221 rotarily drives the sleeve 22 with a fixed pressure. Therefore, it is impossible to adjust the torque according to different requirements.

FIGS. 3 and 4 show two measures for locking the screwdriver bit. In FIG. 3, a C-shaped leaf spring 31 inward presses a steel ball 32 into a conic hole 34 of the sleeve 33. In FIG. 4, a substantially U-shaped leaf spring 35 is inserted in the sleeve 36.

The above two measures both employ the leaf spring to lock the screwdriver bit. In the case that the leaf spring is over-tightened, it will be difficult to insert in or draw out the screwdriver bit or even it may happen that the leaf spring 34 is drawn out along with the screwdriver bit. In the case that the leaf spring is over-loosened, the screwdriver bit is apt to drop down due to poor locking force.

SUMMARY OF THE INVENTION

It is therefore a primary object of the present invention to provide a torque-controlling ratchet connector structure which can easily lock the screwdriver bit, control the rotational direction of the ratchet wheels and adjust the torque for rotating the rotary shaft.

The present invention can be best understood through the following description and accompanying drawing, wherein:

DETAILED DESCRIPTION OF THE PREFERRED EMBODIMENTS

Figure 1:
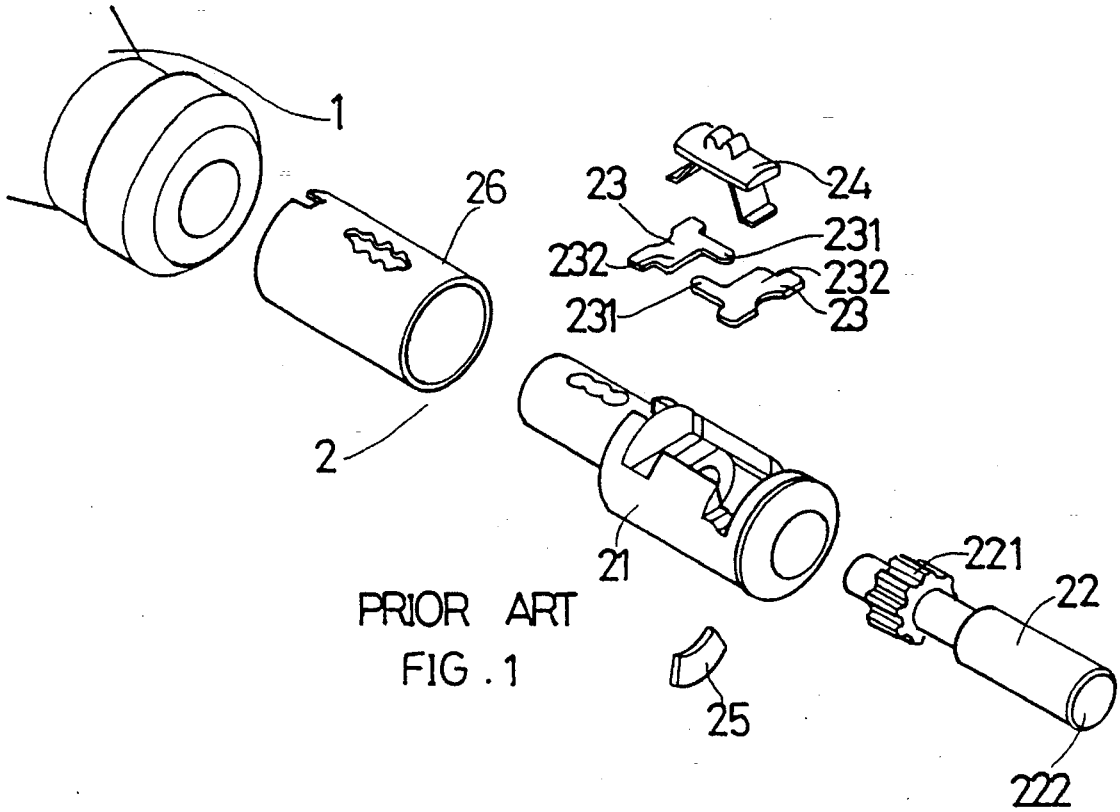
PRIOR ART FIG. 1
FIG. 1 is a perspective exploded view of a conventional ratchet screwdriver.
Figure 2:
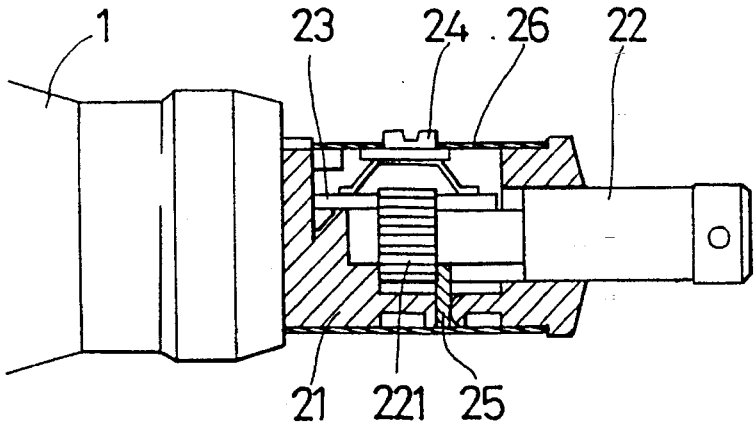
PRIOR ART FIG. 2
FIG. 2 is a longitudinal sectional view of the ratchet screwdriver of FIG. 1.
Figure 3:
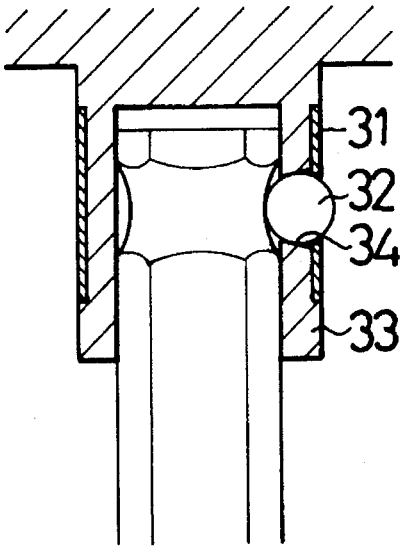
PRIOR ART FIG. 3
FIG. 3 is a sectional view of a conventional locking structure for screwdriver bit.
Figure 4:
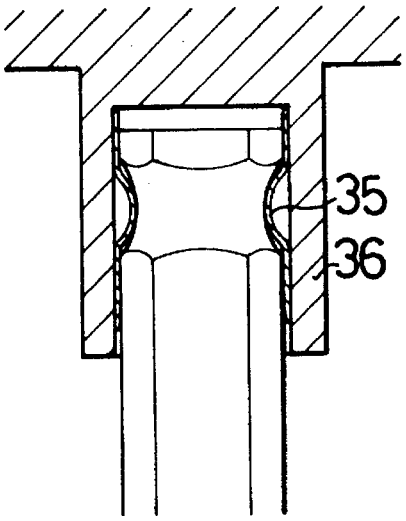
PRIOR ART FIG. 4
FIG. 4 is a sectional view of another conventional locking structure for screwdriver bit.
Figure 5:
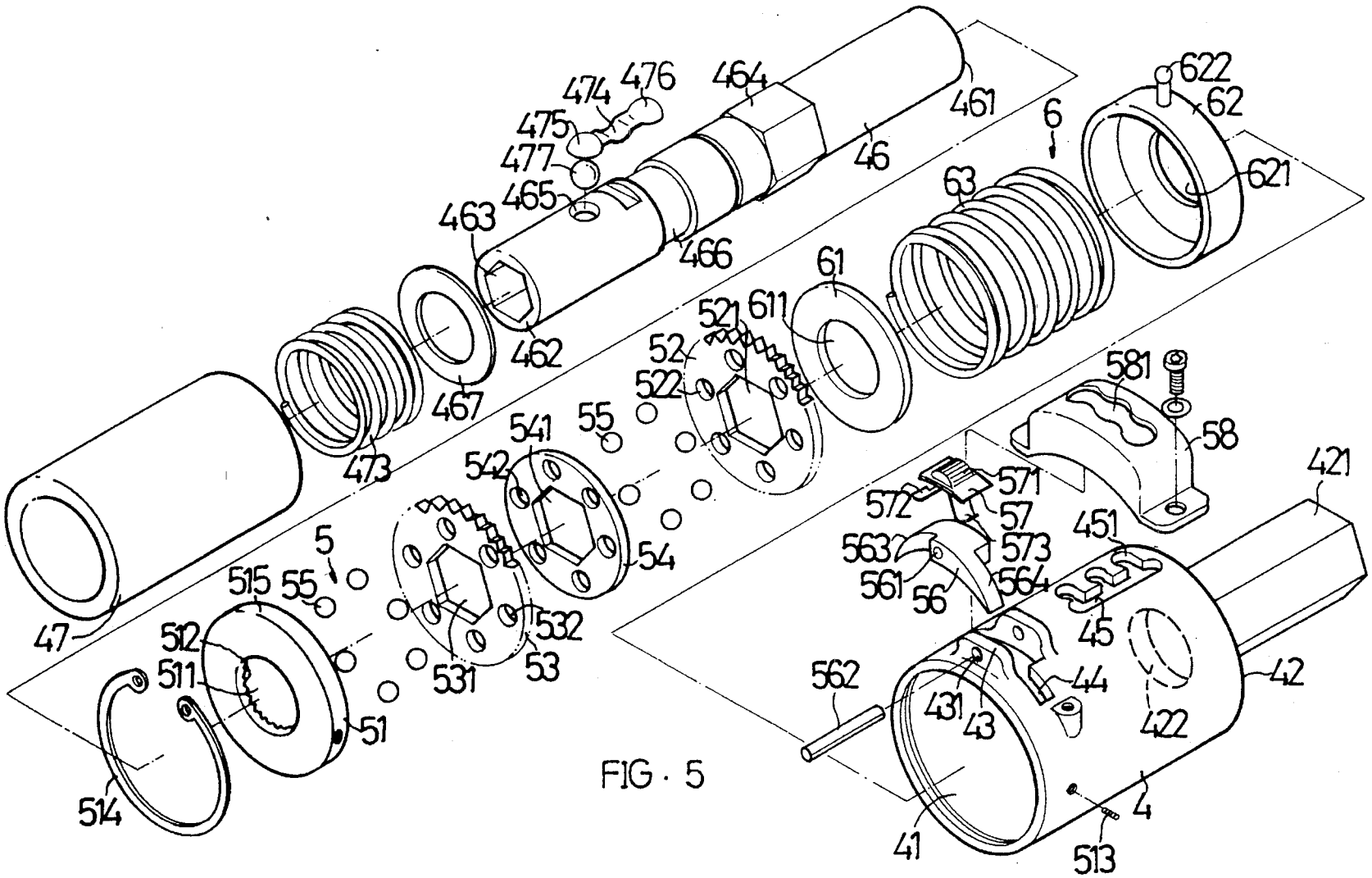
FIG. 5 is a perspective exploded view of a first embodiment of the present invention.
Figure 6:
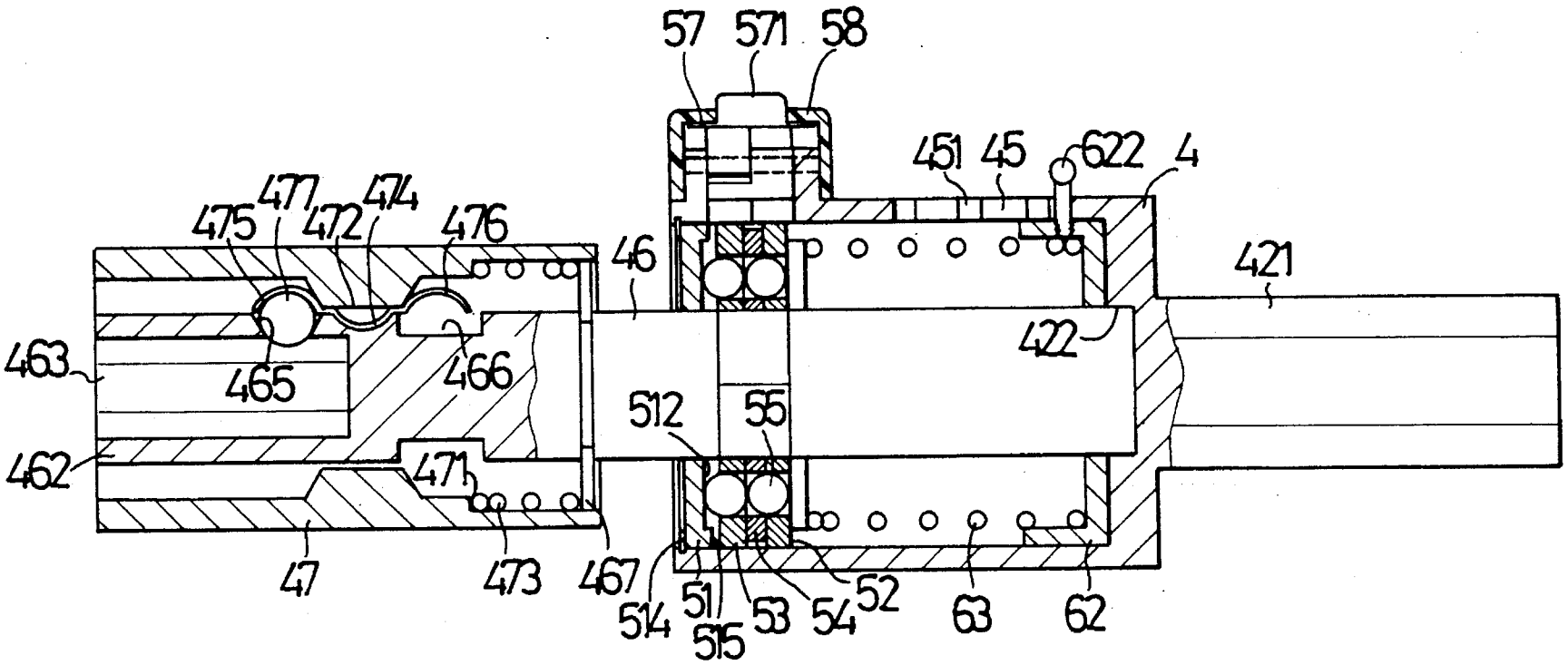
FIG. 6 is a longitudinal sectional assembled view of the first embodiment of the present invention.

Please refer to FIGS. 5 and 6. The torque-controlling ratchet connector structure of the present invention includes a main body 4, a torque mechanism 5 and a pressure adjustment mechanism 6.

The main body 4 is hollow, having a first open end 41 and a second end 42 integrally connected with an axially outward extending hexagonal section 421 for connecting with a pneumatic or electric motor. Two locating seats 43 are disposed on outer side of the main body 4 near the first end 41. Each locating seat 43 is formed with a locating hole 431. A receiving slot 44 is formed between the locating seats 43. A controlling stopper slot 45 is formed on the wall of the main body 4 near the second end 42 parallel to the axis of the main body 4. The controlling stopper slot 45 has several notches 451 on one side. In addition, a shaft hole 422 is formed on inner side of the second end 42 of the main body 4 adjacent to the hexagonal section 421.

A rotary shaft 46 is disposed in the main body 4, having a first end 461 located in the shaft hole 422 of the main body 4 and a second end 462 located in and protruding out of a central shaft hole 511 of a toothed disk 51 disposed in the first open end 41 of the main body 4. The second end 462 is formed with an axial hexagonal socket 463 for inserting a screwdriver bit thereinto. A hexagonal section 464 is formed on a middle section of the rotary shaft 46. Between the second end 462 and the hexagonal section 464 are disposed a conic hole communicating with the hexagonal socket 463 and an annular groove 466 with a predetermined depth. The conic hole 465 is closer to the second end 462. A stopper body 467 is disposed between the annular groove 466 and the hexagonal section 464.

A slide sleeve 47 is fitted around the second end 462 of the rotary shaft 46. A first and a second flanges 471, 472 are formed on inner side of the slide sleeve 47. A spring 473 is disposed between the first flange 471 and the stopper body 467 of the rotary shaft 46. The second flange 472 is positioned between a first and a second ends 475, 476 of an urging member 474. The first and second ends 475, 476 are formed with dome convexes each of which has a highest position higher than a lowest position of the second flange 472. The first end 475 presses a ball member 477 into the conic hole 465 of the rotary shaft 46 and the second end 476 is positioned at the annular groove 466 of the rotary shaft 46, whereby the second flange 472 of the slide sleeve 47 is movable between the first and second ends 475, 476 of the urging member 474 and the slide sleeve 47 is prevented from axially detaching from the second end 462 of the rotary shaft 46.

The torque mechanism 5 includes a toothed disk 51, a first and a second ratchet wheels 52, 53, a washer 54, multiple steel balls 55 and a controlling body 56.

The toothed disk 51 is formed with a central shaft hole 511 for the rotary shaft 46 to pass therethrough and a toothed face 512 facing the interior of the main body 4 and is secured at the open end of the main body 4 by a screw 513. A C-shaped latch ring 514 is disposed between the toothed disk 51 and the first end 41 of the main body 4 to avoid axial detachment of the toothed disk 51 from the main body 4. A flange 515 with a predetermined length and width is disposed along outer periphery of the toothed face 512 to prevent the second ratchet wheel 53 from axially moving and contacting with the toothed face 512.

The first and second ratchet wheels 52, 53 are formed with hexagonal holes 521, 531 for the hexagonal section 464 of the rotary shaft 46 to fit thereinto. Multiple equally spaced ball holes 522, 532 are formed between the peripheries of the ratchet wheels 52, 53 and the hexagonal holes 521,531.

The washer 54 is disposed between the first and second ratchet wheels 52, 53 and formed with a hexagonal hole 541 and multiple ball holes 542 identical to those of the first and second ratchet wheels 52, 53.

The number of the steel balls 55 is twice the number of the ball holes 522, 532, 542 and the diameter of the steel balls 55 is identical to that of the ball holes. Two steel balls 55 are placed in each ball hole 522, 532, 542 of the first and second ratchet wheels 52, 53 and the washer 54, which communicates with the other. The thickness of the two steel balls 55 is larger than the total thickness of the first and second ratchet wheels 52, 53 and the washer 54, so that one of the steel ball 55 is flush with the end face of the first ratchet wheel 52, while the other steel ball 55 protrudes beyond the end face of the second ratchet wheel 53 to contact with the toothed face 512 of the toothed disk 51.

The controlling body 56 is formed with a locating hole 561 at middle section and a pin member 562 is passed through the locating holes 431 of the locating seats 43 of the main body 4 and the locating hole 561 of the controlling body 56 to pivotally connect the same between the locating seats 43. The controlling body 56 is disposed with a first and a second stopper blocks 563, 564 respectively positioned above the toothed peripheries of the first and second ratchet wheels 52, 53. A pushing plate 57 is disposed on the controlling body 56, having a projection 571 on top face for pushing the pushing plate 57 and two V-shaped resilient plates 572, 573 on bottom face for respectively contacting with the first and second stopper blocks 563, 564 of the controlling body 56. An upper cover 58 is fixedly disposed on the pushing plate 57 and formed with a guide slot 581 within which the pushing plate 57 is slidable. The guide slot 581 has three locating sections, whereby the pushing plate 57 is slided to make the resilient plates 572, 573 push and swing the first or second stopper blocks 563, 564 of the controlling body 56. Accordingly, the first or second stopper block 563, 564 is engaged with the first or second ratchet wheel 52, 53 so as to limit the rotational direction thereof.

The pressure adjustment mechanism 6 includes a pressing plate 61, a pressure adjustment body 62 and spring 63.

The pressing plate 61 is formed with a shaft hole 611 for the first end 461 of the rotary shaft 46 to fit therein. The pressing plate 61 is attached to the first ratchet wheel 52 and the steel balls 55.

The pressure adjustment body 62 is formed with a shaft hole 621 for the first end 461 of the rotary shaft 46 to fit therein and has a driving post 622 extending outside the controlling stopper slot 45 of the main body 4. The spring 63 is disposed between the pressure adjustment body 62 and the pressing plate 61. The driving post 622 is selectively located in one of the notches 451 of the controlling stopper slot 45 so as to adjust the pressure exerted by the spring 63 onto the pressing plate 61, the first ratchet wheel 52 and the steel balls 55 at the end face thereof. Accordingly, the torque exerted by the toothed disk 51 onto the rotary shaft 46 for rotating the same is adjustable.

Figure 7:
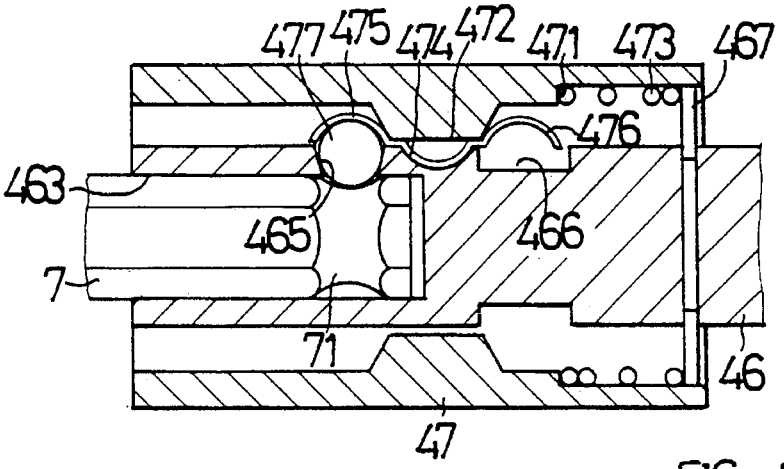
FIG. 7 is a sectional view of the connector portion of the first embodiment, showing a first state thereof.
Figure 8:
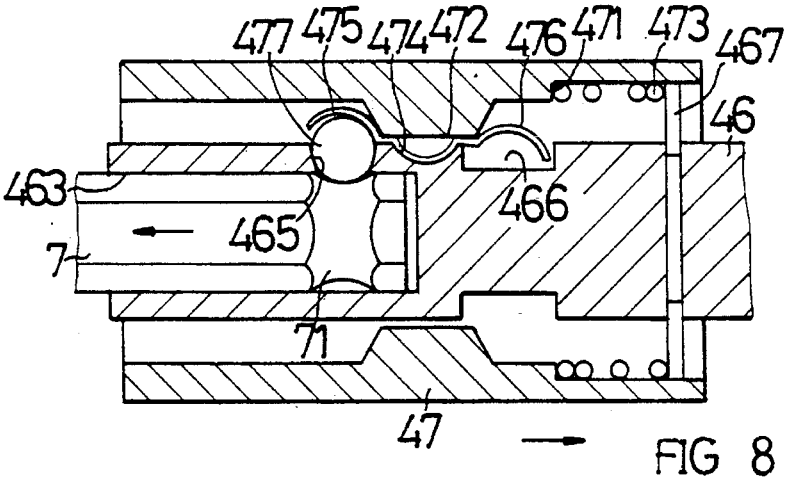
FIG. 8 is a sectional view of the connector portion of the first embodiment, showing a second state thereof.

According to the above arrangements, the torque-controlling ratchet connector structure of the present invention includes three portions as follows:

1. Connector portion: Please refer to FIG. 7. The second flange 472 of the slide sleeve 47 is slidable between the first and second ends 475, 476 of the urging member 474. However, by means of the pushing of the spring 473 between the first flange 471 and the stopper body 467 of the rotary shaft 46, the second flange 472 normally presses the first end 475, making a part of the ball member 477 protrude out of the conic hole 465 into the hexagonal socket 463 so as to engage with a locating groove 71 of the screwdriver bit 7 and avoid axial detachment thereof. Moreover, the ball member 477 is radially pressed by the first end 475 of the urging member 474 and the first end 475 is axially pressed by the second flange 472. Therefore, it is impossible to axially pull the screwdriver bit 7 out of the socket 463. Please refer to FIG. 8. When the slide sleeve 47 is manually pushed toward the main body 4, the second flange 472 will urge the second end 476 to move toward the annular groove 466, making the first end 475 moved upward. At this time, a clearance is formed between the first end 475 and the ball member 477, permitting the ball member 477 to radially move away from the socket 463. Accordingly, the ball member 477 is disengaged from the locating groove 71 of the screwdriver bit 7, permitting the same to be pulled outward from the socket 463.

Figure 9:
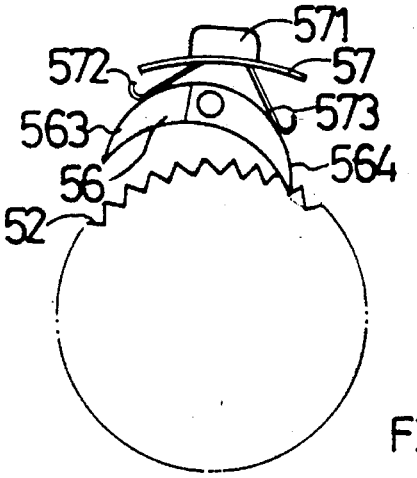
FIG. 9 is a sectional view of the torque portion of the first embodiment.

2. Torque mechanism: Please refer to FIG. 6. The toothed face 512 of the toothed disk 51 is engaged with multiple steel balls 55 which drive the first and second ratchet wheels 52, 53. By means of the engagement between the hexagonal holes 521, 531, 541 and the hexagonal section 464 of the rotary shaft 46, the rotary shaft 46 is rotarily driven. Therefore, the torque for rotating the rotary shaft 46 is determined by the contacting pressure between the toothed face 512 and the steel balls 55. With respect to the controlling of the rotational direction of the rotary shaft 46, it is controlled by the first stopper block 563 (on outer surface of the first ratchet wheel 52) and by the second stopper block 564 (on the outer surface of the second ratchet wheel 53) of the substantially Z-shaped controlling body 56. Referring to FIG. 9, by means of the sliding of the pushing plate 57, the resilient plates 572 urges the controlling body 56 to swing toward one side, making the first stopper block 563 thereof engaged with the first ratchet wheel 52. At this time, the first and second ratchet wheels 52, 53 can be only one-way rotated from the middle section of the controlling body 56 to the first stopper block 563. In the case that the pushing plate 57 is reversely pushed, the resilient plates 572 will urge the controlling body 56 to swing toward the other side, making the second stopper block 564 engaged with the second ratchet wheel 53. At this time, the first and second ratchet wheels 52, 53 can be reversely rotated. In the case that the pushing plate 57 is positioned at the middle section of the guide slot 581, the resilient plates 572, 573 simultaneously press the first and second stopper blocks 563, 564 of the controlling body 56, making the same disengaged from the first or second ratchet wheels 52, 53. At this time, the rotary shaft 46 is free from the restriction of rotational direction and is only controlled by the torque from the spring 63, the first and second ratchet wheels 52, 53, the steel balls 55 and the toothed disk 51.

3. Pressure adjustment mechanism: Please refer to FIG. 6. The rotary shaft 46 is rotated by the torque created from the contacting pressure between the steel balls 55 and the toothed face 512 of the toothed disk 51. The spring 63 between the pressure adjustment body 62 and the pressing plate 61 urges the first ratchet wheel 52 and the steel balls 55 to move toward the toothed face 512 to create the pressure. By means of the selectively locating the driving post 62 in one of the notches 451 of the stopper slot 45, the distance between the pressure adjustment body 62 and the pressing plate 61 is adjusted so as to adjust the pressure exerted by the spring 63 onto the first ratchet wheel 52 and the steel balls 55 against the toothed face 512.

Figure 10:
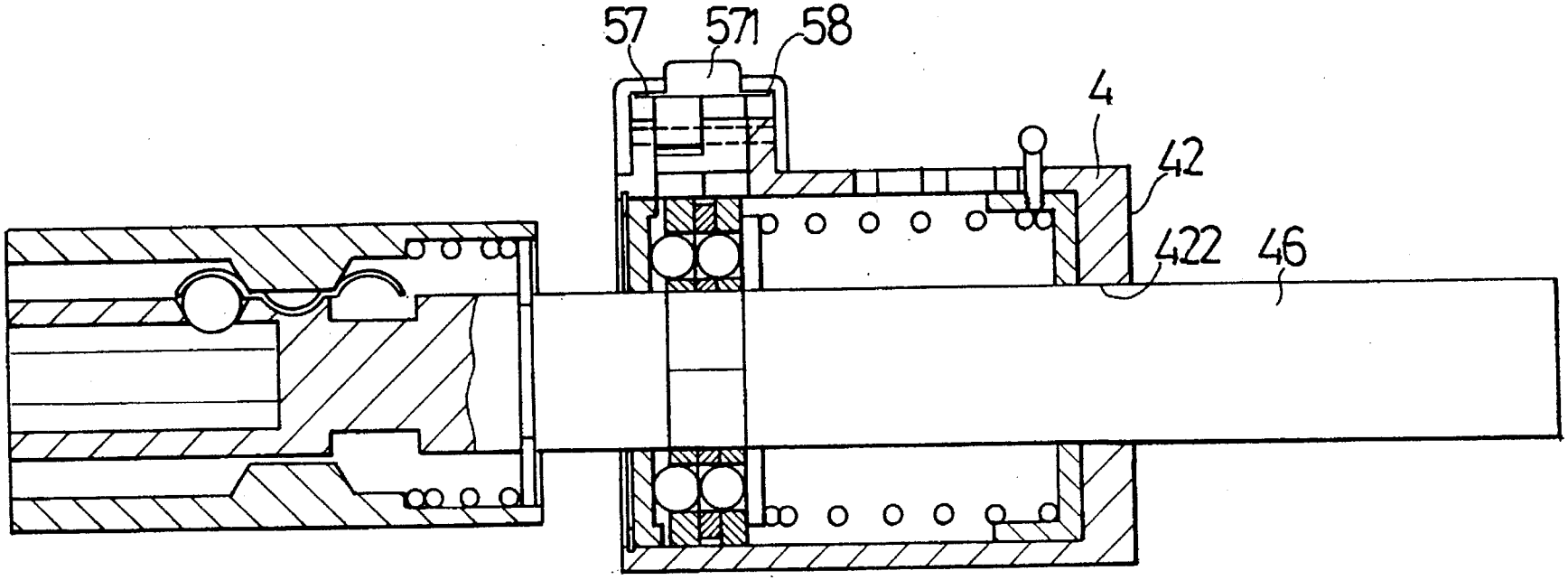
FIG. 10 is a sectional assembled view of a second embodiment of the present invention.

FIG. 10 shows a second embodiment of the present invention, in which the rotary shaft 46 extends out of the shaft hole 422 of the main body 4 to connect with an electric or a pneumatic motor. In the case that the pushing plate 57 is pushed to the middle section, the rotary shaft 46 is free from the restriction of rotational direction by the ratchet wheels and is only subject to the torque controlled by the pressure adjustment body 62.

In conclusion, the pressure adjustment mechanism 6, the torque mechanism 5 and the connector are assembled into an integral body which can easily lock the screwdriver bit, control the rotational direction of the ratchet wheels and adjust the torque for rotating the rotary shaft.

It is to be understood that the above description and drawings are only used for illustrating some embodiments of the present invention, not intended to limit the scope thereof. Any variation and derivation from the above description and drawings should be included in the scope of the present invention.

What is claimed is:

1. A torque-controlling ratchet connector structure comprising:

a hollow main body having a first open end and a second end integrally connected with an axially outward extending hexagonal section, two locating seats being disposed at the first end of the main body, a receiving slot being formed between the locating seats, a controlling stopper slot being formed at the second end of the main body, a shaft hole being formed on inner side of the second end of the main body adjacent to the hexagonal section;

a rotary shaft disposed in the main body, having a first end located in the shaft hole of the main body and a second end located in and protruding out of a central shaft hole of a toothed disk disposed in the first open end of the main body, the second end being formed with an axial hexagonal socket, a hexagonal section being formed on a middle section of the rotary shaft, between the second end and the hexagonal section being disposed a conic hole communicating with the hexagonal socket and an annular groove with a predetermined depth, a stopper body being disposed between the annular groove and the hexagonal section;

a slide sleeve fitted around the second end of the rotary shaft, a first and a second flanges being formed on inner side of the slide sleeve, a spring being disposed between the first flange and the stopper body of the rotary shaft, the second flange being positioned between a first and a second ends of an urging member, each of the first and second ends having a highest position higher than a lowest position of the second flange, the first end pressing a ball member into the conic hole of the rotary shaft and the second end being positioned at the annular groove of the rotary shaft, whereby the second flange of the slide sleeve is movable between the first and second ends of the urging member and the slide sleeve is prevented from axially detaching from the second end of the rotary shaft;

a torque mechanism including:

a toothed disk formed with a central shaft hole and a toothed face facing the interior of the main body and secured at the first end of the main body, a flange with a predetermined length and width being disposed along outer periphery of the toothed face;

a first and a second ratchet wheels formed with hexagonal holes for the hexagonal section of the rotary shaft to fit thereinto, multiple equally spaced ball holes being formed between the peripheries of the ratchet wheels and the hexagonal holes;

a washer disposed between the first and second ratchet wheels and formed with a hexagonal hole and multiple ball holes identical to those of the first and second ratchet wheels;

multiple steel balls having a diameter identical to that of the ball holes, two steel balls being placed in each ball hole of the first and second ratchet wheels and the washer, which communicates with the other, the thickness of the two steel balls being larger than the total thickness of the first and second ratchet wheels and the washer, so that one of the steel balls is flush with the end face of the first ratchet wheel, while the other steel ball protrudes beyond the end face of the second ratchet wheel to contact with the toothed face of the toothed disk; and a controlling body pivotally connected with the locating seats of the main body at middle section, the controlling body being disposed with a first and a second stopper blocks respectively positioned above the toothed peripheries of the first and second ratchet wheels; and a pressure adjustment mechanism including;

a pressing plate formed with a shaft hole for the first end of the rotary shaft to fit therein, the pressing plate being attached to the first ratchet wheel and the steel balls;

a pressure adjustment body formed with a shaft hole for the first end of the rotary shaft to fit therein and having a driving post extending outside the controlling stopper slot of the main body, a spring being disposed between the pressure adjustment body and the pressing plate, the controlling stopper slot being parallel to the axis of the main body and having several notches on one side for the driving post to insert thereinto.

2. A ratchet connector structure as claimed in claim 1, wherein a C-shaped latch ring is disposed between the first open end of the main body and the toothed disk so as to avoid axial detachment thereof from the main body.

3. A ratchet connector structure as claimed in claim 1, wherein the first and second ends of the urging member are formed with dome convexes for restricting the sliding travel of the second flange of the slide sleeve in such a manner that when the second flange presses the dome convex of the second end into the annular groove of the rotary shaft, a clearance is formed between the dome convex of the first end and the ball member, permitting a screwdriver bit to be installed into the hexagonal socket of the rotary shaft and when the second flange presses the dome convex of the first end to force the ball member to protrude out of the conic hole into the hexagonal socket and the locating groove of the screwdriver bit, the same is locked and prevented from axially detaching from the hexagonal socket.

4. A ratchet connector structure as claimed in claim 1, wherein the controlling body is formed with a locating hole at middle section and a pin member is passed the locating holes of the locating seats of the main body and the locating hole of the controlling body to pivotally connect the same between the locating seats, a pushing plate being disposed on the controlling body and having two V-shaped resilient plates for respectively contacting with the first and second stopper blocks of the controlling body, an upper cover being fixedly disposed on the pushing plate and formed with a guide slot within which the pushing plate is slidable.

5. A ratchet connector as claimed in claim 1, wherein the rotary shaft extends out of the shaft hole of the main body.

* * * * *